US006516687B1

(12) United States Patent
Hile et al.

(10) Patent No.: US 6,516,687 B1
(45) Date of Patent: Feb. 11, 2003

(54) DEVICE FOR HOLDING A CONTAINER WHILE REMOVING A TWIST-ON LID

(76) Inventors: Jeffrey B. Hile, 719 Wexford-Bayne Rd., Wexford, PA (US) 15090; Michael F. Johnson, 8940 Woodland Dr., Poland, OH (US) 44514

( * ) Notice: Subject to any disclaimer, the term of this patent is extended or adjusted under 35 U.S.C. 154(b) by 0 days.

(21) Appl. No.: 10/087,528

(22) Filed: Mar. 1, 2002

(51) Int. Cl.[7] ..... B67B 7/00
(52) U.S. Cl. ..... 81/3.25; 81/3.3 R; 269/289 R
(58) Field of Search ..... 81/3.25, 3.31, 81/3.32, 3.36, 3.39; 269/289 R, 303, 315

(56) References Cited

U.S. PATENT DOCUMENTS

| | | | | | |
|---|---|---|---|---|---|
| 750,654 | A | * | 1/1904 | Johnson | 81/3.32 |
| 1,837,257 | A | | 12/1931 | Eames | |
| 2,064,381 | A | * | 12/1936 | McColgan | 81/3.32 |
| 2,127,301 | A | * | 8/1938 | Kriska | 81/3.32 |
| 2,288,218 | A | * | 6/1942 | Warren | 81/3.25 |
| 2,515,655 | A | | 7/1950 | Kormuth | |
| 4,085,632 | A | * | 4/1978 | Hogan et al. | 81/3.25 |
| 4,262,560 | A | | 4/1981 | Hoffberger | |
| 5,209,142 | A | | 5/1993 | Dickson | |
| 5,546,831 | A | * | 8/1996 | Grant et al. | 81/3.25 |
| 5,664,466 | A | | 9/1997 | Miller | |
| 5,943,920 | A | | 8/1999 | McGivern et al. | |

* cited by examiner

*Primary Examiner*—James G. Smith
(74) *Attorney, Agent, or Firm*—Carothers & Carothers

(57) ABSTRACT

A device for holding a container while removing a twist-on lid for the container. The device includes a horizontal base having a top surface for supporting the bottom of the container. Two vertical elongate legs are secured side-by-side along bottom surfaces thereof to the top surface of the base and the legs extend divergently with respect to each other whereby inner left and right opposing surfaces of the legs, as horizontally viewed therein from the most divergent ends of the legs, face each other to form a wedge for engaging bottom side portions of a container positioned therebetween. An elastic surface is disposed on the left of the inner opposing surfaces for gripping bottom side surfaces of a container engaging and being rotated between the inner opposing surfaces of the legs. The opposing surfaces of the legs extend upwardly from the base in a height of between two to three inches. The top surface of the base is stepped upwardly between the inner surfaces of the legs at portions where the inner surfaces are most convergent for engaging containers having shallow side walls and a small diameter therebetween. The base of the device may be horizontally extended or retracted so that the device fits snugly within a drawer.

4 Claims, 5 Drawing Sheets

DEVICE FOR HOLDING A CONTAINER WHILE REMOVING A TWIST-ON LID

BACKGROUND OF THE INVENTION

This invention relates to a device that is used to open bottles or other containers having screw-on or twist-on closures, and more specifically to container holding devices utilizing a V-wedge construction for holding a jar against rotation so as to permit removal or replacement of twist-on closures.

Containers, such as jars, with over-tightened screw-on or twist-on closures or caps are difficult to open even for the average person. Persons with only one hand, arthritis and other hand-weakening afflictions, have even more difficulties opening twist-on closures for jars or containers. This also holds true for small containers with twist-on lids, such as medicine bottles with childproof caps.

It is a principal object of the present invention is to provide a device for holding a container against rotation while removing a twist-on lid for the container which is inexpensive to construct, easily accessible and highly effective.

SUMMARY OF THE INVENTION

The device of the present invention is configured for holding a container, such as a jar, while removing a twist-on lid for the container. The device comprises a horizontal base having a top surface for supporting the bottom of a container to be opened. The container bottom is rested upon this top surface. Two horizontal elongate legs are provided and secured side-by-side along bottom surfaces thereof to the top surface of the base. These legs extend in a V fashion or divergently with respect to each other whereby inner left and right opposing surfaces thereof, as horizontally viewed therein between the legs from the most divergent ends of the legs, face each other to form a wedge for engaging bottom side portions of a container which is positioned between the legs for gripping the container against rotation.

An elastic surface is disposed on the left of these inner opposing surfaces for gripping bottom side surfaces of a container which are engaged with the inner opposing surfaces of the legs in order to unscrew or untwist the closure or cap on the container. An elastic surface may also be disposed on the right of the inner opposing surfaces for the purpose of holding a jar between the legs securely while a lid or closure is being twisted back on to the container.

These opposing surfaces of the legs extend upwardly from the base in height of between two to three inches. This height extension is important. If the height extension is too short, the inner surfaces of the legs will not properly grip the bottom portion of the container positioned therebetween. If the height is too short, then the container positioned between the legs tends to tilt to the side and is not properly gripped to provide maximum gripping for removal of the twist-on closure. If the height of the inner surfaces of the legs is too high, then the device of the present invention will not fit within a conventional cabinet drawer as found in most kitchens.

Another feature of the device of the present invention is that the top surface of the base is stepped upwardly between the inner opposing surfaces of the legs at portions wherein the inner surfaces of the legs are most convergent for engaging containers having shallow side walls and a small diameter, such as medicine bottles or small jars.

Yet another feature of the present invention includes means for horizontally dimensionally adjusting the base of the device. In particular, the device of the present invention is dimensioned to fit within a cabinet drawer of the kitchen and the base of the device of the present invention may be dimensionally adjusted to fit the internal width of the drawer. This prevents the device from turning and maintains it in a stationary condition while being engaged to remove a twist-on closure from a jar or container. In the embodiment described, the device is positioned in the drawer whereby the extension legs extend from the base and with the width of the drawer and the base of the device may thereby be adjusted to snugly fit the width of the drawer.

BRIEF DESCRIPTION OF THE DRAWINGS

Other objects and advantages appear hereinafter in the following description and claims. The accompanying drawings show, for the purpose of exemplification, without limiting the scope of the invention or appended claims, certain practical embodiments of the present invention wherein:

DETAILED DESCRIPTION OF A PREFERRED EMBODIMENT

Figure 1:
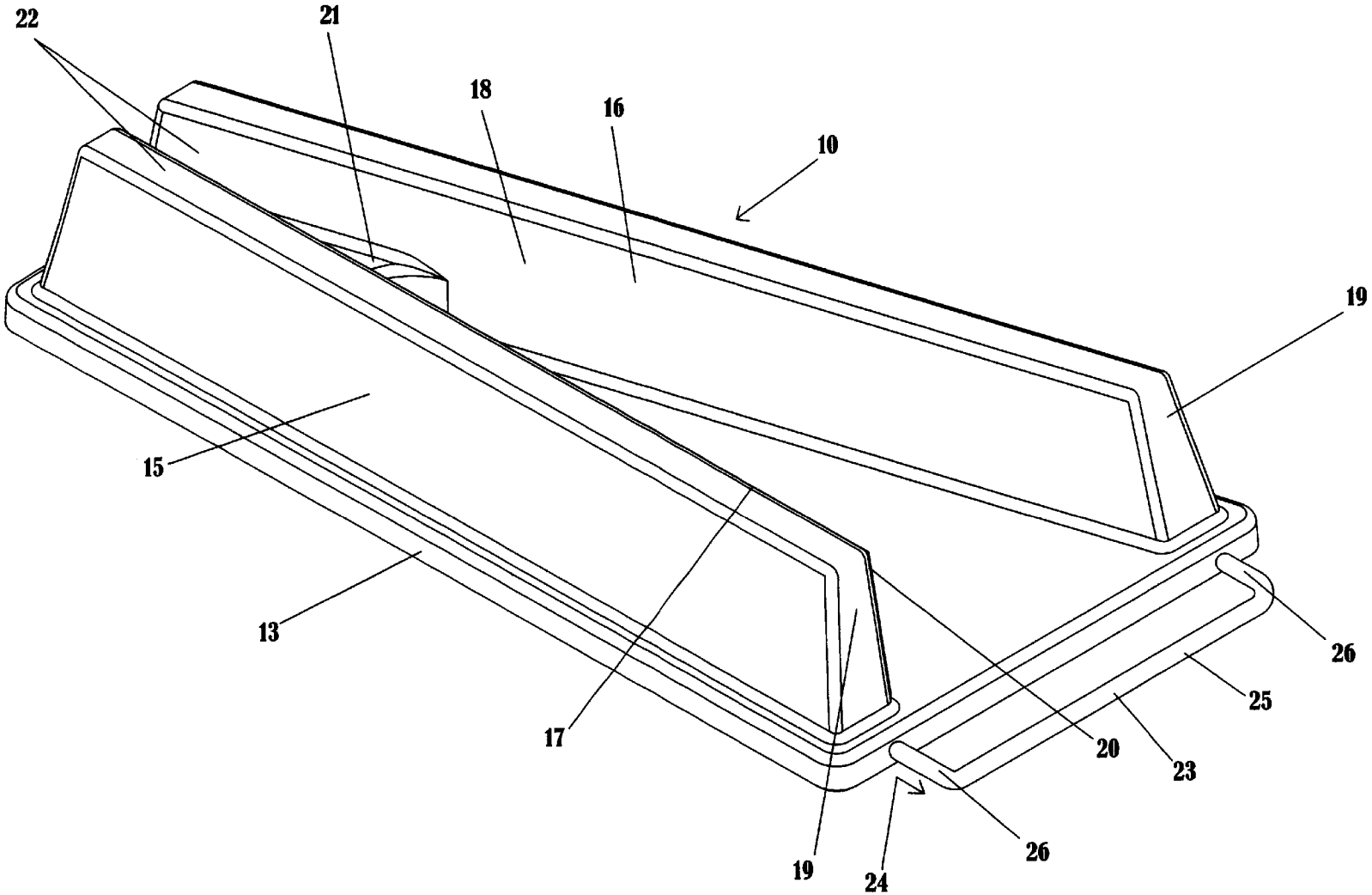
FIG. 1 is a perspective view of the container holding device of the present invention.
Figure 2:
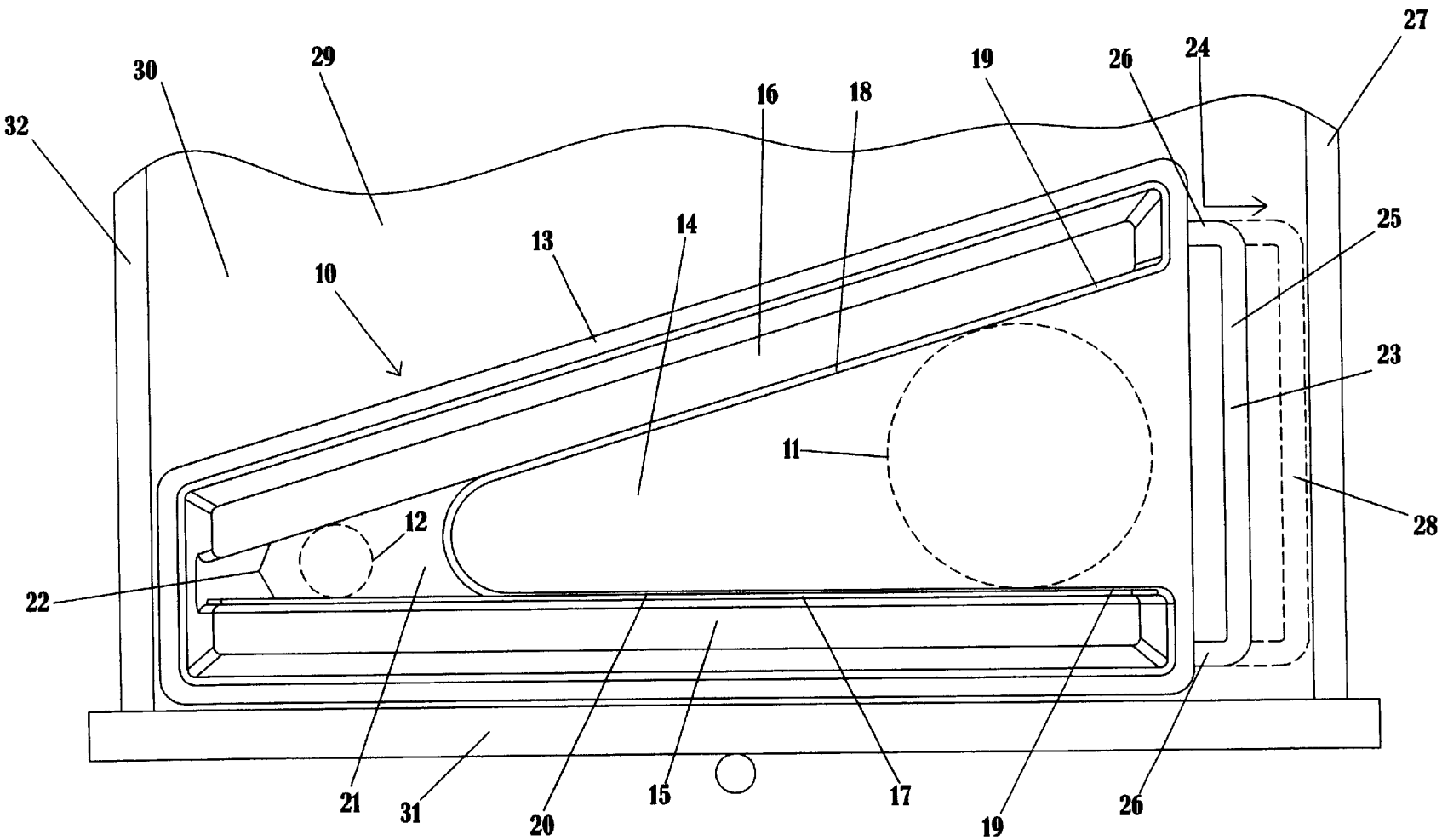
FIG. 2 is a top or plan view of the device shown in FIG. 1 and installed in a drawer.
Figure 3:
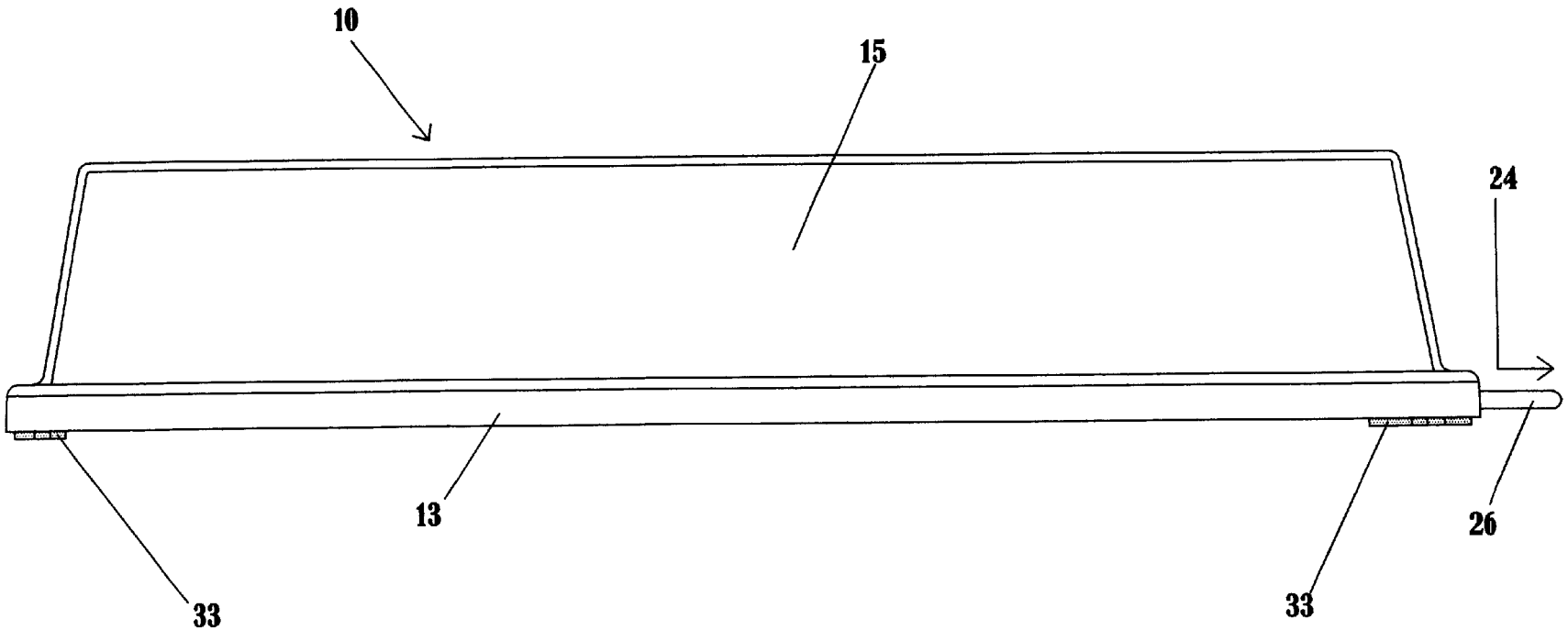
FIG. 3 is a view in front elevation of the container holding device of FIGS. 1 and 2.

Referring to the drawings, the device 10 of the present invention for holding a container, such as a can, jar or the like, while removing a twist-on lid for the container is illustrated. The device 10 of the present invention is designed and dimensioned to retain the bottom portions of a jar or other container 11 or 12 as illustrated in dashed outline in the plan view of FIG. 2. The dashed circle outline 11 shown in FIG. 2 illustrates the base of a jar of larger diameter, such as a sauerkraut or pickle jar, or any other container of similar size and the dashed circle 12 illustrates the circumference of a smaller and more shallow container such as a childproof plastic medicine bottle or a glass shallow bottle of small diameter with a twist-on lid such as is utilized for canning pimentos or other small food stuffs.

Figure 4:
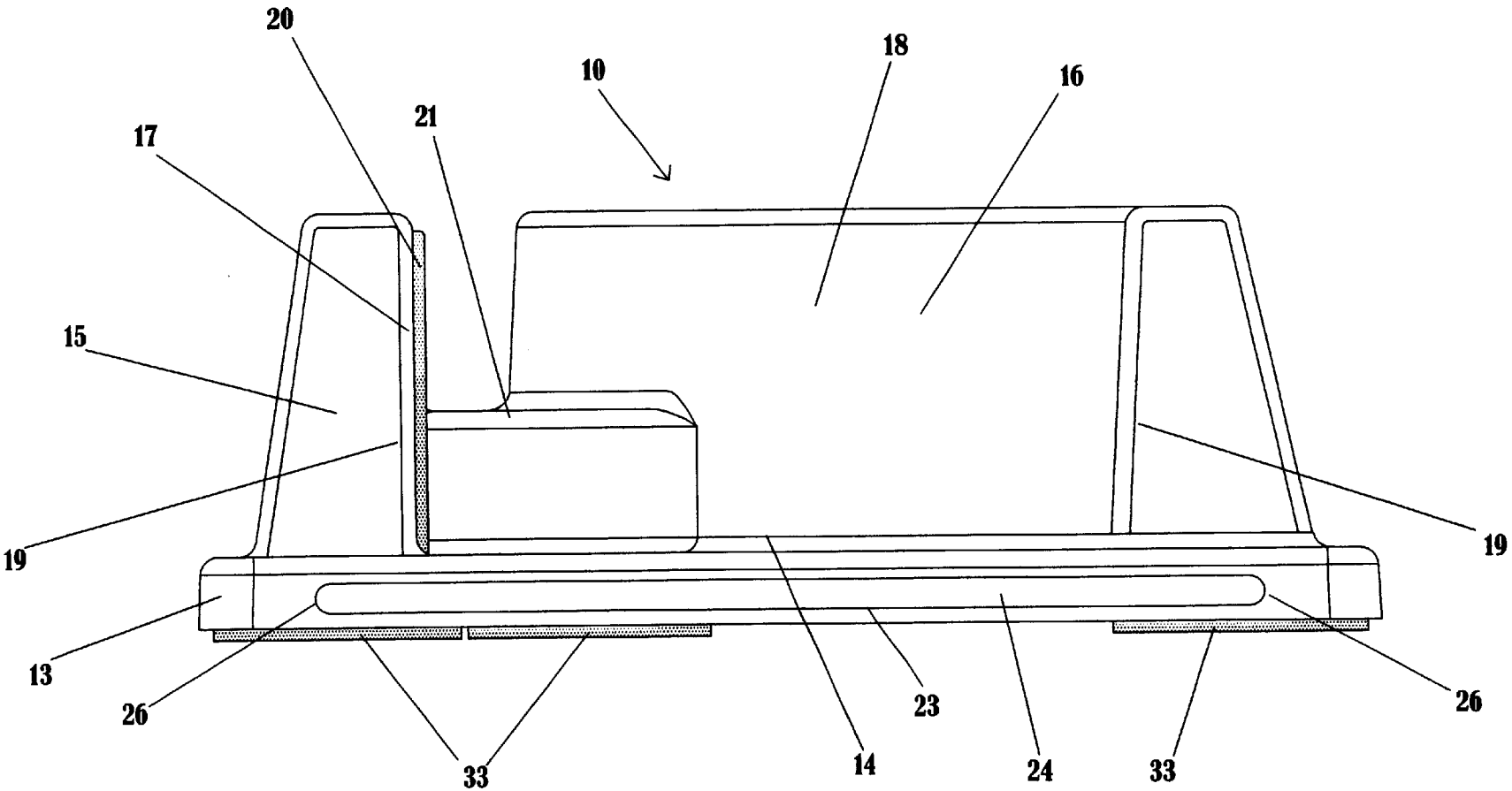
FIG. 4 is right end view in elevation of the device of the present invention shown in FIGS. 1, 2 and 3.
Figure 5:
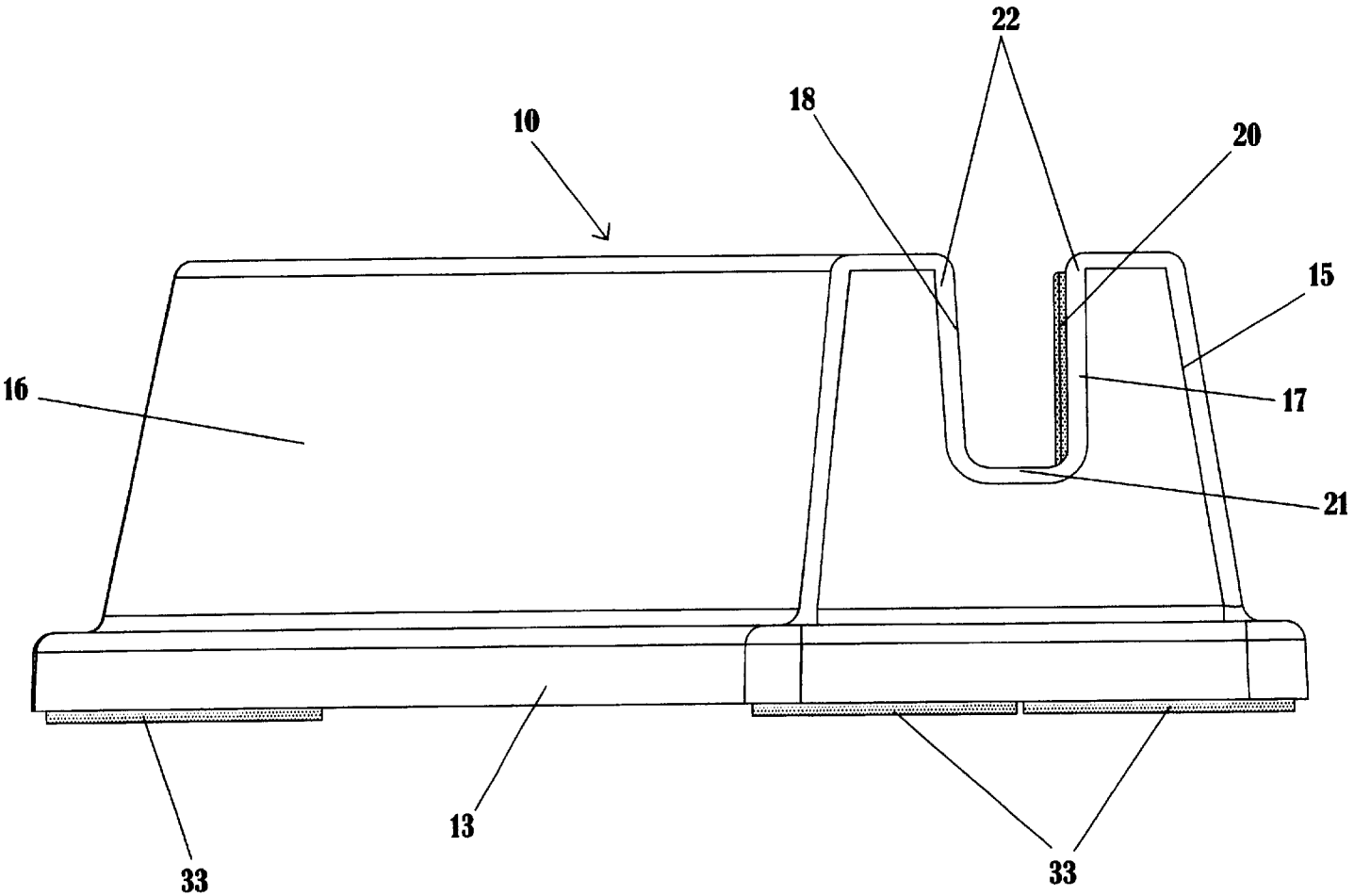
FIG. 5 is a left end view in elevation of the container holding devices of the present invention illustrated in FIGS. 1 through 4.

The device 10 includes a horizontal base 13 having a top surface 14 for supporting the bottoms of containers 11 thereon. The device 10 is further provided with two vertical elongate legs 15 and 16 which are secured side-by-side along bottom surfaces thereof to top surface 14 of base 10. Legs 15 and 16 extend divergently with respect to each other whereby inner left surface 17 and inner right surface 18 are opposing surfaces respectively of legs 15 and 16, as horizontally viewed therein from the most divergent ends 19 of legs 15 and 16, or as viewed in FIG. 4. Left and right opposing surfaces 17 and 18 face each other to form a wedge for engaging bottom side portions of a container 11 or 12 positioned therebetween. An elastomer or elastic surface 20 is disposed on the left inner opposing surface 17 for gripping bottom side surfaces of a container, such as containers 11 or 12, which containers are engaging inner opposing surfaces 17 and 18 have applied rotational forces for removing a lid. The elastic surface 20 is provided on the left opposing surface 17 for gripping the bottom portions of containers 11 and 12 when being rotated counterclockwise for removal of a twist-on lid or closure (not shown) thereon. Of course, if the device is to be used for also replacing a twist-on lid onto container 11 or 12, an elastic surface may also be provided on inner right surface 18 of leg 16.

The inner surfaces 17 and 18 extend upwardly from upper surface 14 of base 13 to a height of between two to three inches. This feature is critical in that if the height is less than two inches the container bottom is not sufficiently engaged and the container 11 or 12 becomes too easily dislodged from between the diverging legs 15 and 16. If the height is in excess of three inches, then the device 10 will not sit in shallower cabinet drawers of the kitchen.

The top surface 14 of base 10 is stepped upwardly to a higher level to provide top surface 21 between inner surfaces 17 and 18 of legs 15 and 16 at portions 22 wherein inner surfaces 17 and 18 are most convergent, for engaging therebetween containers 12 having shallow side walls and a small diameter.

The base 13 includes means 23 for horizontally dimensionally adjusting the base 13 in the horizontal direction as indicated by arrow 24. This means 23 consists of a stiff wire which has a cross member 25 and two parallel legs 26 which extend into the base 13 through apertures which provide a tight sliding fit for legs 26. Accordingly, the means 23 may be slid outwardly to the right as viewed in FIG. 2 to engage the inner side wall of drawer side 27 as indicated in dashed outline at 28.

As seen in FIG. 2, the device 10 is set down into the bottom of drawer 29 which is provided with drawer bottom 30, drawer face 31 and vertical sides 27 and 32. The base 13 of the device 10 is then adjusted as previously explained with adjustment means 23 to fully fit the width of drawer 29 so that when containers 11 and 12 are twisted by pressure applied to their lids or closures, the device 10 will remain stable and will not rotate within in drawer 29. Drawer 29 has a shallow depth of approximately three inches. In this embodiment the legs 15 and 16 extend with the width of the drawer so that the device 10 is positioned at the front of the drawer for easy access. Other items may be stored in the drawer behind the device 10.

The means 23 for horizontally dimensionally adjusting base 13 may take on other forms. For example, instead of having the wire device illustrated in the drawings, the base 13 may be extended to the right as viewed in FIG. 2 and be provided with incremental break-off segments of base 13 which are easily broken off to shorten the overall length of base 13 as seen in the left to right direction.

The bottom of base 13 is also provided with elastomeric or resilient feet 33 in order to prevent the base from rotating or sliding on a surface when engaged in use either in a drawer or on a counter top.

We claim:

1. A device for holding a container while removing a twist-on lid for the container, the device comprising:

a horizontal base having a top surface for supporting a bottom of a container thereon;

two vertical elongate legs secured side by side along bottom surfaces thereof to said top surface of said base and extending horizontally and divergently with respect to each other whereby inner left and right opposing surfaces thereof, as horizontally viewed therein from the most divergent ends of said legs, face each other to form a wedge for engaging bottom side portions of a container positioned therebetween;

an elastic surface disposed on the left of said inner opposing surfaces for gripping bottom side surfaces of a container engaging and being rotated between said inner opposing surfaces;

said opposing surfaces extending upwardly from said base in height of between two to three inches;

said top surface of said base is stepped upwardly between said inner surfaces of said legs at portions wherein said inner surfaces are most convergent for engaging containers having shallow side walls and a small diameter therebetween.

2. A device for holding a container while removing a twist-on lid for the container, the device comprising:

a horizontal base having a top surface for supporting a bottom of a container thereon;

two vertical elongate legs secured side by side along bottom surfaces thereof to said top surface of said base and extending horizontally and divergently with respect to each other whereby inner left and right opposing surfaces thereof, as horizontally viewed therein from the most divergent ends of said legs, face each other to form a wedge for engaging bottom side portions of a container positioned therebetween;

an elastic surface disposed on the left of said inner opposing surfaces for gripping bottom side surfaces of a container engaging and being rotated between said inner opposing surfaces;

said base includes means for horizontally dimensionally adjusting said base.

3. The device of claim 2, in combination with a cabinet drawer having a given width and depth, and wherein said base is dimensionally adjustable to fit the width of the drawer.

4. The device of claim 3, wherein said base extends with the width of said drawer.

* * * * *